US006007461A

United States Patent [19]

Winston

[11] Patent Number: 6,007,461

[45] **Date of Patent: *Dec. 28, 1999**

[54] AQUATIC EXERCISE DEVICE

[76] Inventor: Edith Winston, 135 Hazelwood Dr., Jericho, N.Y. 11753

[ * ] Notice: This patent is subject to a terminal disclaimer.

[21] Appl. No.: 08/527,784

[22] Filed: Sep. 13, 1995

[51] Int. Cl.[6] ..... A63B 31/12; A63B 21/065

[52] U.S. Cl. ..... 482/55; 482/105; 441/55; 441/60; 2/252

[58] Field of Search ..... 482/55, 56, 74, 482/92, 93, 105, 139; 128/DIG. 15; 602/78; 2/251, 912, 252; 441/55, 59, 60

[56] References Cited

U.S. PATENT DOCUMENTS

| | | | |
|---|---|---|---|
| 3,537,108 | 11/1970 | Daniels | 2/252 |
| 4,684,123 | 8/1987 | Fabry | 482/105 |
| 4,838,546 | 6/1989 | Winston | 482/105 |
| 4,905,991 | 3/1990 | Alston | 482/55 |
| 4,949,887 | 8/1990 | Holmes | 2/912 |
| 5,004,227 | 4/1991 | Hoffman | 482/55 |
| 5,007,412 | 4/1991 | DeWall | 128/DIG. 15 |
| 5,547,445 | 8/1996 | Chang | 482/105 |
| 5,820,526 | 10/1998 | Hoffman | 482/105 |

OTHER PUBLICATIONS

"Velcro" Product News, Jan. 1975, PN No. 10, newsletter published by Velcro Corp., NY, NY.

"Velcro" Product News, received in the US PTO Jul. 19, 1976, newsletter published by Velcro Corp., NY, NY.

*Primary Examiner*—Richard J. Apley
*Assistant Examiner*—Victor Hwang
*Attorney, Agent, or Firm*—Myron Amer P.C.

[57] ABSTRACT

An exercise device with compartment-housed weights sometimes used without all weights in place, adapted for use in a pool environment by a flap which is held in place over the compartments by "VELCRO" hook and loop fasteners so as to contribute to providing a hermetic seal so that there is nominal seepage of water into empty compartments as might inadvertently add to the weight used for exercise routines.

1 Claim, 2 Drawing Sheets

4
7
58
56
60
20
54
18
4
7

34
60
40
50
52
8
8
44
36
34
32
48
46
24
26
52
36
40
56

AQUATIC EXERCISE DEVICE

The present invention relates to an exercise device using, at the option of a user, a range of weights that are adapted for use in a pool environment.

EXAMPLE OF THE PRIOR ART

As illustrated and described in my prior U.S. Pat. No. 5,127,891 issued on Jul. 7, 1992 for "Wrist Exercise Device", the advantages of using a device worn in encircling relation about a selected limb, i.e. wrist or ankle, and with a selected number of weights, are already well known. Exemplary uses of the '891 device are for exercise routines in gyms and for use during walking and/or jogging.

Underlying the present invention is the recognition that the aforesaid apparent wide range of utility or use is not as broad as it could be, in that the exercises noted must be practiced in appropriate environments for those exercises.

Broadly, it is an object of the present invention to provide an exercise device generally of the nature noted, but of utility not limited to prior environments of use, to thereby overcome shortcomings in this regard in the prior art.

More particularly, it is an object to adapt the exercise device of the nature noted, while maintaining all advantageous structure for practicing exercising routines, also for use in a pool environment, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

An exercise device of a type adapted to be worn in encircling relation about a user's limb, such as a wrist, or in the present case shown in use about an ankle, is generally already known, as for example being illustrated and described in my prior U.S. Pat. No. 5,127,891 issued on Jul. 7, 1992 for "Wrist Exercise Device". These types of exercise devices heretofore, however, were limited in use for walking and/or jogging and correspondingly limited in use to appropriate environments for these exercises.

Figure 1:
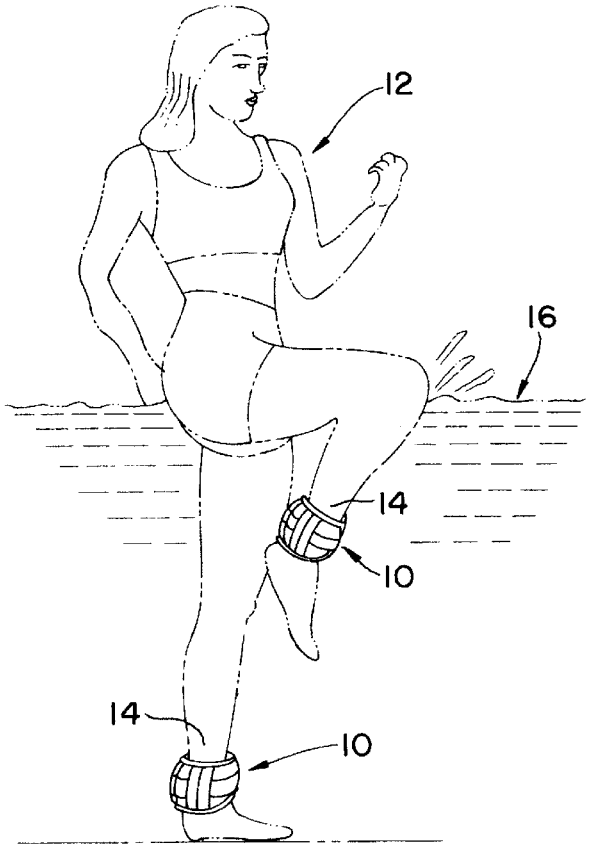
FIG. 1 is a perspective view of an exercise device adapted in accordance with the present invention for aquatic use and illustrated as used in an exercise routine in a pool environment.

In contrast, the within inventive exercise device, designated 10 in FIG. 1 is shown in encircling relation or worn about a user 12's ankles 14 and in the environment of a pool 16, having been adapted for this aquatic end use by structural changes to the '891 exercise device as will now be described in detail.

Figure 7:
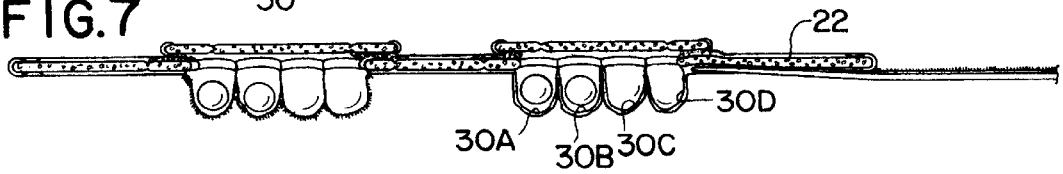
FIG. 7 is a sectional view as taken along line 7—7 of FIG. 2.
Figure 5:
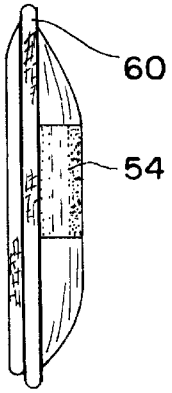
FIG. 5 is a left end elevational view of the exercise device of FIG. 2.
Figure 6:
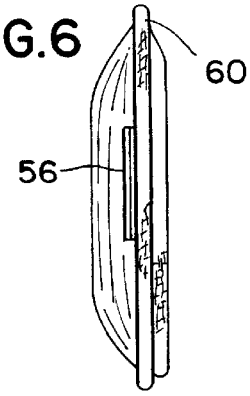
FIG. 6 is a right end elevational view of the exercise device of FIG. 2.
Figure 2:
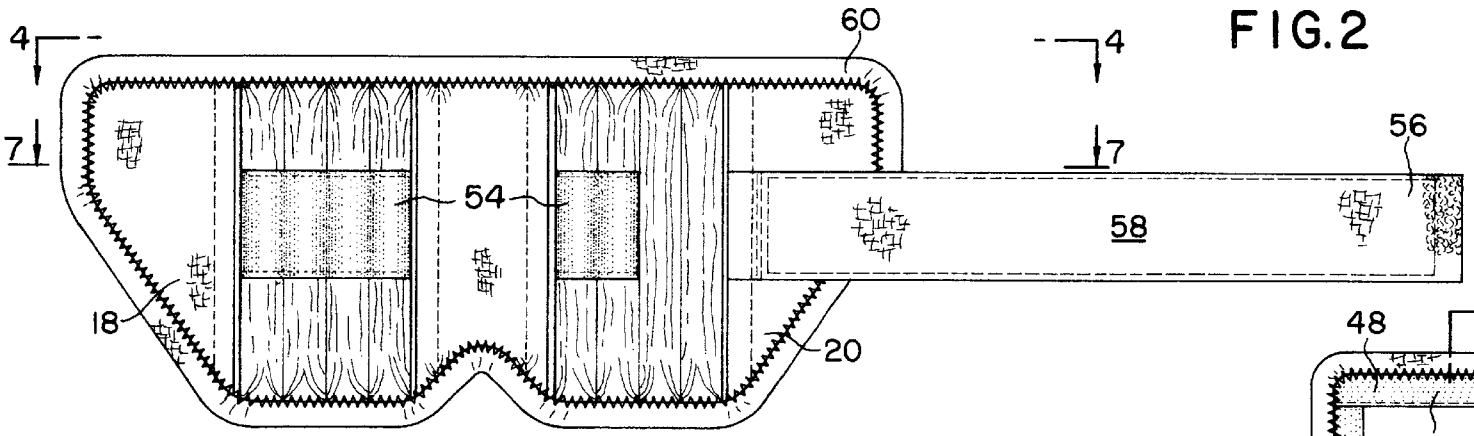
FIG. 2 is an isolated elevational view of the exercise device as seen from the side or exterior surface in outwardly facing relation from a user.

Consistent with maximizing its beneficial use in exercising, the device 10 includes adjacent body panels 18 and 20 of fabric covered foam construction material 22 (FIG. 7) on the inside surface 24 of each of which there is attached by spaced stitching 26 a fabric panel 28 which is appropriately configured to provide weight-receiving compartments, individually and collectively designated 30, the fabric panels 28 having adjacent removed material cooperating to bound an opening 32 into the compartments 30 for the insertion therethrough into a cooperating compartment of appropriately shaped and sized rust-proof metal weights 34. At the option of the user 12 all compartments can be filled with weights 34 or, more typically, some compartments, as noted by compartments 30A and 30B can be filled with weights and the remaining compartments 30C and 30D can be allowed to remain empty, and in this way the device 10 is used with a range of exercise weights at the option of the user.

Figure 8:
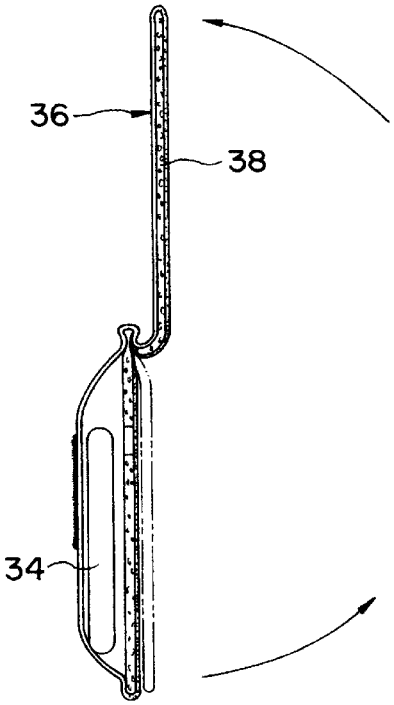
FIG. 8 is a sectional view as taken along line 8—8 of FIG. 3.
Figure 4:
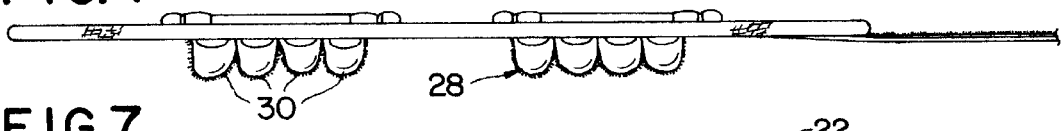
FIG. 4 is a plan view as seen along line 4—4 of FIG. 2.
Figure 3:
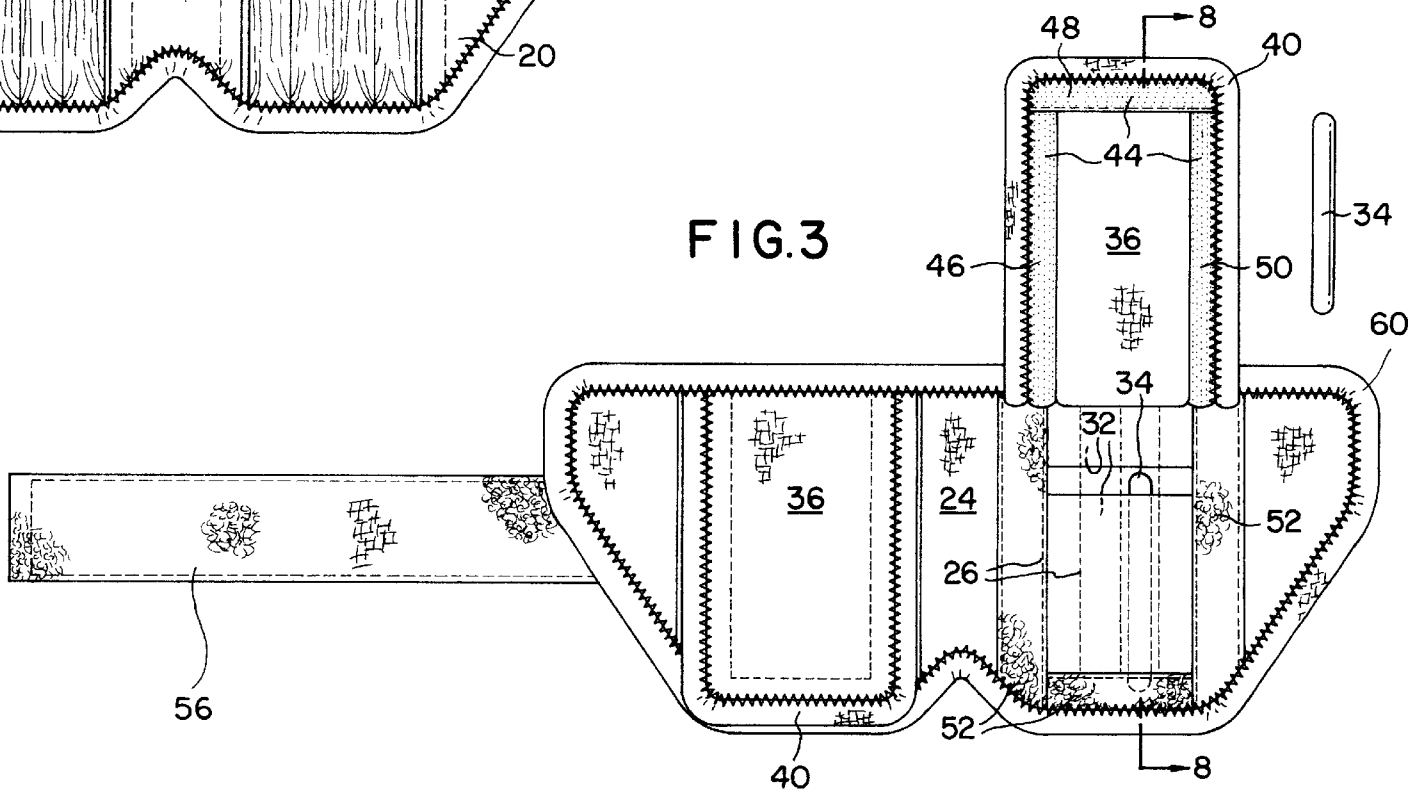
FIG. 3 is a view similar to FIG. 2 but as seen from the opposite inside surface thereof as would be in contact with a user and shown with a flap thereof in an open condition.

Underlying the present invention is the recognition that, to preserve to the user the weight variation option as just noted, adaptation for aquatic use requires obviating the seepage of water into the empty compartments 30C and 30D since these compartments, when filled with water, add unintended weight to the device 10. This is structurally implemented in accordance with the present invention by providing identically constructed flaps 36, each of fabric coated foam construction material 38 and finished with edge piping 40, which flaps are stitched across the tops of the locations of the two groups of compartments 30 so that each flap can be folded from an open condition as shown to the right in FIG. 3 in covering relation, as shown to the left, over the compartments 30, and uncovered therefrom as shown in FIG. 8, each of the flaps 36 in their covering condition serving, by virtue of their interposed position between the device 10 and user 12, to cushion the feel of the weights 34 against the user 12 and thus correspondingly adding to the comfort in the use of the device 10.

Additionally, each flap 36 to adapt the device 10 for aquatic use is provided, by stitching, adhesion or other appropriate manner, with hooks 44, sold under the trademark "VELCRO" hook and loop fasteners, along the three sides 46, 48 and 50, which are adapted to align and make contact with loops 52, sold under the trademark "VELCRO" hook and loop fastners, appropriately affixed to the body panels 18 and 20 in encircling relation about the groups of compartments 30.

In practice, it has been found that contact of the hooks 44 and loops 52 with each other not only detachably holds the flap 36 closed over the opening 32 into the unfilled compartments 30C and 30D, but provides an equivalent of a hermetic seal for the groups of the compartments 30 thereby contributing during use in a pool 16, as illustrated in FIG. 1, an optimum nominal seepage of water into any unfilled compartments, such as 30C and 30D, as might add to the weight selected by the user 12 for exercise routines of the nature illustrated in FIG. 1.

For completeness sake it is noted that appropriately adhered VELCRO hooks 54 on the exterior of the body panels 18 and 20 and VELCRO loops 56 on a laterally extending strap 58 are adapted to engage each other to form the device 10 into a closed loop incident to being worn about a selected limb of the user 12, and that piping 60 is applied about the peripheral edges of the body panels 18 and 20 to contribute to providing a finished appearance to the device 10.

While the exercise device herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for adapting for aquatic use of an exercise device of a type worn in encircling relation about a selected limb of a user having plural compartments for receiving in inserted relation therein cooperating weights and in the use of which only some of the compartments may be filled with weights and others empty, said improvements to the exercise device comprising:

a rectangular flap having an upper edge attached to the exercise device so as to be positioned in covering relation over the partially filled and unfilled weight-receiving compartments; and hook and loop fasteners disposed on a lower surface of said flap along opposite sides and a lower edge peripherally surrounding a central area, said central area of said lower surface being free of hook and loop fasteners, said hook and loop fasteners adapted to contact underlying complimentary hook and loop fasteners disposed on the exercise device in encircling relation about the compartments to contribute to providing a hermetic seal for the compartments, whereby in a swimming pool environment there is nominal seepage of water into unfilled compartments as might add to the weight selected by the user for exercise routine.

* * * * *